US006295694B1

(12) United States Patent
Dyson et al.

(10) Patent No.: US 6,295,694 B1
(45) Date of Patent: Oct. 2, 2001

(54) APPARATUS FOR CARRYING A FLUID FLOW

(75) Inventors: James Dyson; Alexander Stuart Knox; Michael David Ganderton, all of Wiltshire (GB)

(73) Assignee: Notetry Limited (GB)

( * ) Notice: Subject to any disclaimer, the term of this patent is extended or adjusted under 35 U.S.C. 154(b) by 0 days.

(21) Appl. No.: 09/509,112

(22) PCT Filed: Sep. 17, 1998

(86) PCT No.: PCT/GB98/02816

§ 371 Date: Jul. 27, 2000

§ 102(e) Date: Jul. 27, 2000

(87) PCT Pub. No.: WO99/15066

PCT Pub. Date: Apr. 1, 1999

(30) Foreign Application Priority Data

Sep. 23, 1997 (GB) ..... 9720215

(51) Int. Cl.[7] ..... A47L 5/32
(52) U.S. Cl. ..... 15/334; 15/335
(58) Field of Search ..... 15/331, 334, 335, 15/333

(56) References Cited

U.S. PATENT DOCUMENTS 3,300,806 * 1/1967 Ripple ..... 15/334
4,376,322 3/1983 Lockhart et al. .
4,573,236 * 3/1986 Dyson ..... 15/334 X
5,355,549 * 10/1994 Steinberg et al. ..... 15/334
5,551,120 * 9/1996 Cipolla et al. ..... 15/333
6,079,077 * 6/2000 Kajihara et al. ..... 15/334 X

FOREIGN PATENT DOCUMENTS 0 134 654 3/1985 (EP) .
2 325 399 11/1998 (GB) .

* cited by examiner

*Primary Examiner*—Chris K. Moore
(74) *Attorney, Agent, or Firm*—Morrison & Foerster LLP

(57) ABSTRACT

The invention provides an apparatus for carrying a fluid flow having at least one fluid inlet, at least one fluid outlet, a plurality of alternative fluid flow paths therebetween and valve for selecting one of the said fluid flow paths to carry a fluid flow from the or a fluid inlet to the or a fluid outlet, wherein the said valve (14) and at least part of the said alternative fluid flow paths (26, 70) are housed within a removable portion (10) of the apparatus to facilitate maintenance. Preferably, seals (32) are provided between the removable portion (10) and the remainder of the apparatus, the seals (32) being either carried by the removable portion (10) or exposed for access by removal of the removable portion (10). This arrangement facilitates removal of blockages and replacement of seals.

13 Claims, 7 Drawing Sheets

APPARATUS FOR CARRYING A FLUID FLOW

The invention relates to apparatus for carrying a fluid flow. More particularly, the invention relates to apparatus for carrying a fluid flow having at least one fluid inlet, at least one fluid outlet and a plurality of alternative fluid flow paths therebetween. The apparatus can be adapted for carrying any fluid, i.e. liquid or gas, but is particularly suitable for carrying an airflow. The invention is particularly suitable for use in vacuum cleaners.

Known apparatus for carrying a fluid flow having a plurality of alternative fluid flow paths between the at least one fluid inlet and the at least one fluid outlet incorporates a valve for selecting one of the said fluid flow paths to carry a fluid flow from the or a fluid inlet to the or a fluid outlet. An example of a known vacuum cleaner incorporating a valve of this type is shown and fully described in European patent No. 0134654B. This known prior art automatically selects the appropriate air inlet of the vacuum cleaner and directs air from either the ground-engaging cleaning head or the hose and wand to the inlet of the dust separating apparatus of the vacuum cleaner. The selection of the appropriate air inlet is carried out automatically by the relative positioning of the body of the cleaner and the cleaner head during normal floor cleaning or above-floor cleaning. Other prior art vacuum cleaners incorporate manual switches which must be operated by the user of the vacuum cleaner in order to selectively direction the airflow from either the cleaner head or the hose and wand.

In the known prior art, air is directed from one of two possible air inlets to a single air outlet via dust separating apparatus. Inevitably, at least one of these alternative airflow paths includes a significant bend to bring the airflow into the correct orientation to enter the dust separating apparatus before exiting via the fluid outlet. Whenever the airflow path of a vacuum cleaner incorporates a significant bend, there is an increased risk of blockages occurring. Also, in selecting one of the alternative fluid flow paths, the or each of the remaining fluid flow paths must be sealed against the incoming airflow. Therefore, a number of seals must be provided in the area of the valve in order to prevent loss of suction. These seals are vulnerable to wear and must be replaced at relatively frequent intervals in order to maintain optimum performance of the vacuum cleaner.

In prior art vacuum cleaners, it has been found to be somewhat awkward to gain access to the portions of the relevant airflow paths in the region of the valve in which blockages can occur. It has also been found awkward to gain access to the relevant seals to effect replacement at appropriate times. It is therefore perceived that there is a need to improve the construction of apparatus of this type, particularly when forming part of a vacuum cleaner, in order to facilitate maintenance and repair.

It is therefore an object of the present invention to provide apparatus for carrying a fluid flow in which access to areas requiring maintenance is enhanced. It is a further object of the present invention to provide apparatus for carrying a fluid flow in which blockages occurring in the fluid flow paths can be easily and quickly cleared. A further object of the invention is to provide apparatus for carrying a fluid flow in which seals which are prone to wear can be accessed easily for rapid replacement. It is a further object of the present invention to provide a vacuum cleaner having a flow direction selector valve in which blockages occurring at or near the valve can be easily and quickly removed. It is a further object of the invention to provide a vacuum cleaner in which a significant proportion of the seals which are prone to wear can be easily and quickly accessed for replacement.

The invention provides apparatus for carrying a fluid flow as claimed in claim 1. Further and advantageous features are set out in the subsidiary claims.

The provision of a removable portion in which the valve for opening the said alternative fluid flow paths and closing the or each remaining fluid flow path is housed allows the user of the apparatus to remove the removable portion should any blockages occur in the fluid flow paths. The removal of the removable portion gives the user of the apparatus easy access to the alternative fluid flow paths which allows removal of any blockages quickly and easily. Any seals provided between the removable portion and the remainder of the apparatus are advantageously either carried by the removable portion or exposed by its removal so that, in the event of any of these seals requiring replacement, easy access is provided by the removal of the removable portion. The removable portion is preferably retained in an operational position with respect to the remainder of the apparatus by quick release clips, e.g. resilient push-button snaps, to enable an unskilled user of the apparatus to carry out basic maintenance and removal of blockages. This reduces the amount of profession time required to maintain the apparatus and keeps the apparatus operational for longer periods thus increasing user satisfaction and decreasing the amount of time required for maintenance and repair.

A preferred embodiment of the apparatus according to the invention will now be described in detail with reference to the accompanying drawings in which.

Figure 2:
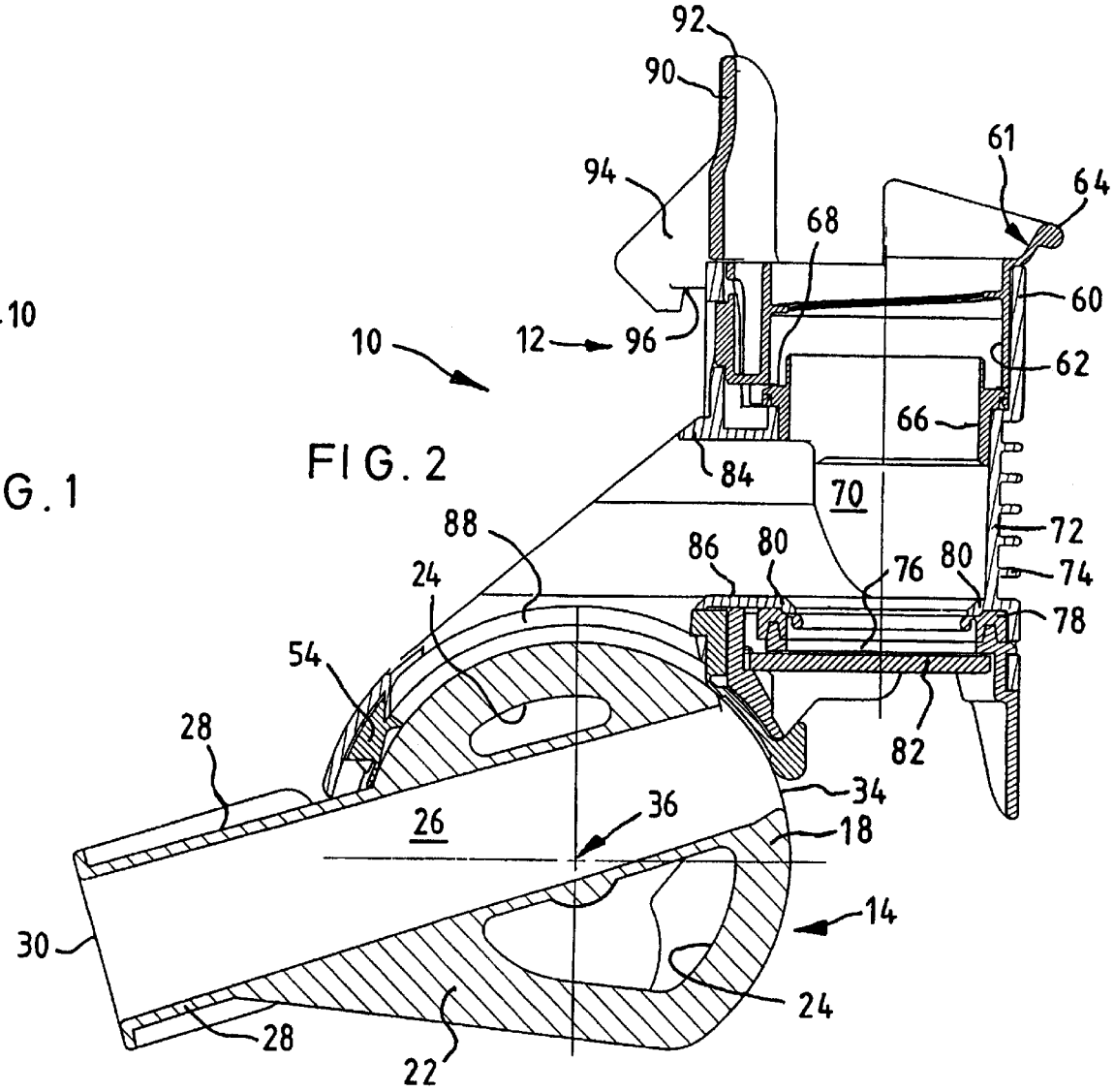
FIG. 2 is a longitudinal cross-sectional view of the removable portion shown in FIG. 1 and taken along line II—II.
Figure 1:
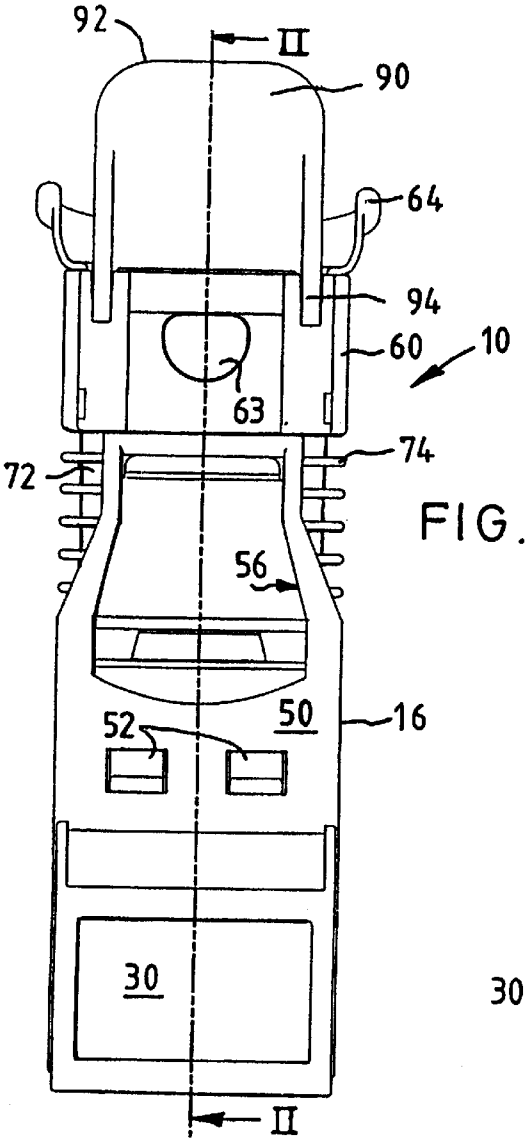
FIG. 1 is a front view of a removable portion of an embodiment of apparatus for carring a fluid flow in accordance with the invention.
Figure 3:
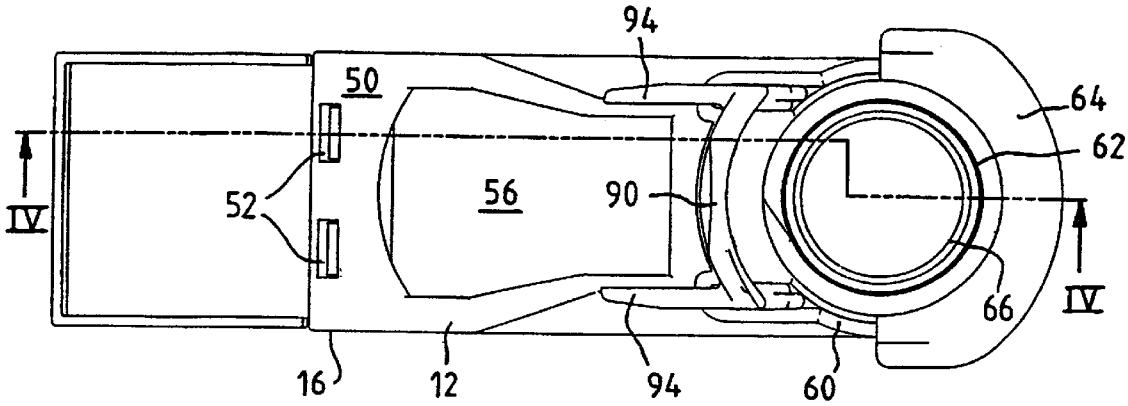
FIG. 3 is a plan view of the removable portion shown in FIGS. 1 and 2.
Figure 4:
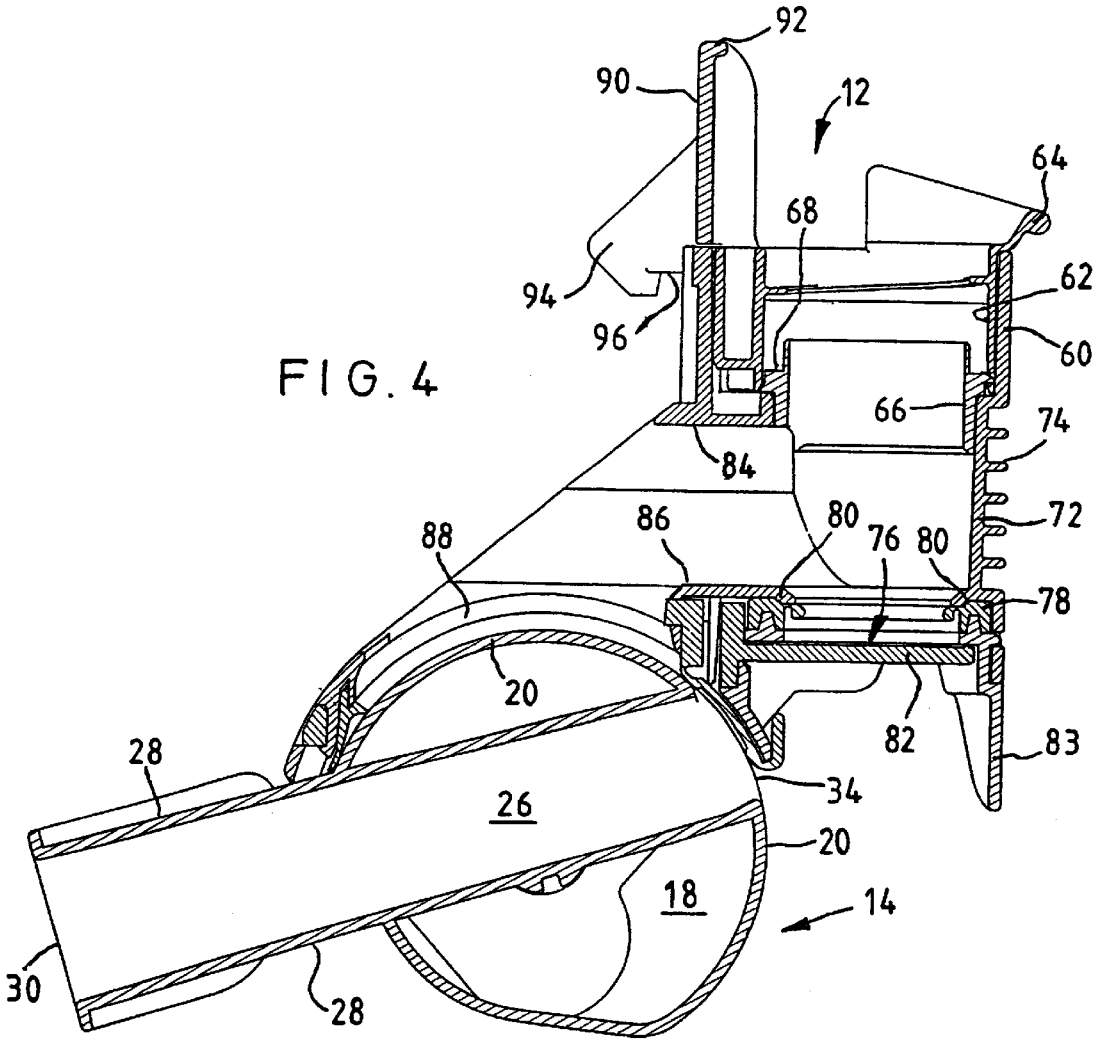
FIG. 4 is a cross-sectional view taken along line IV—IV of FIG. 3.
Figure 5:
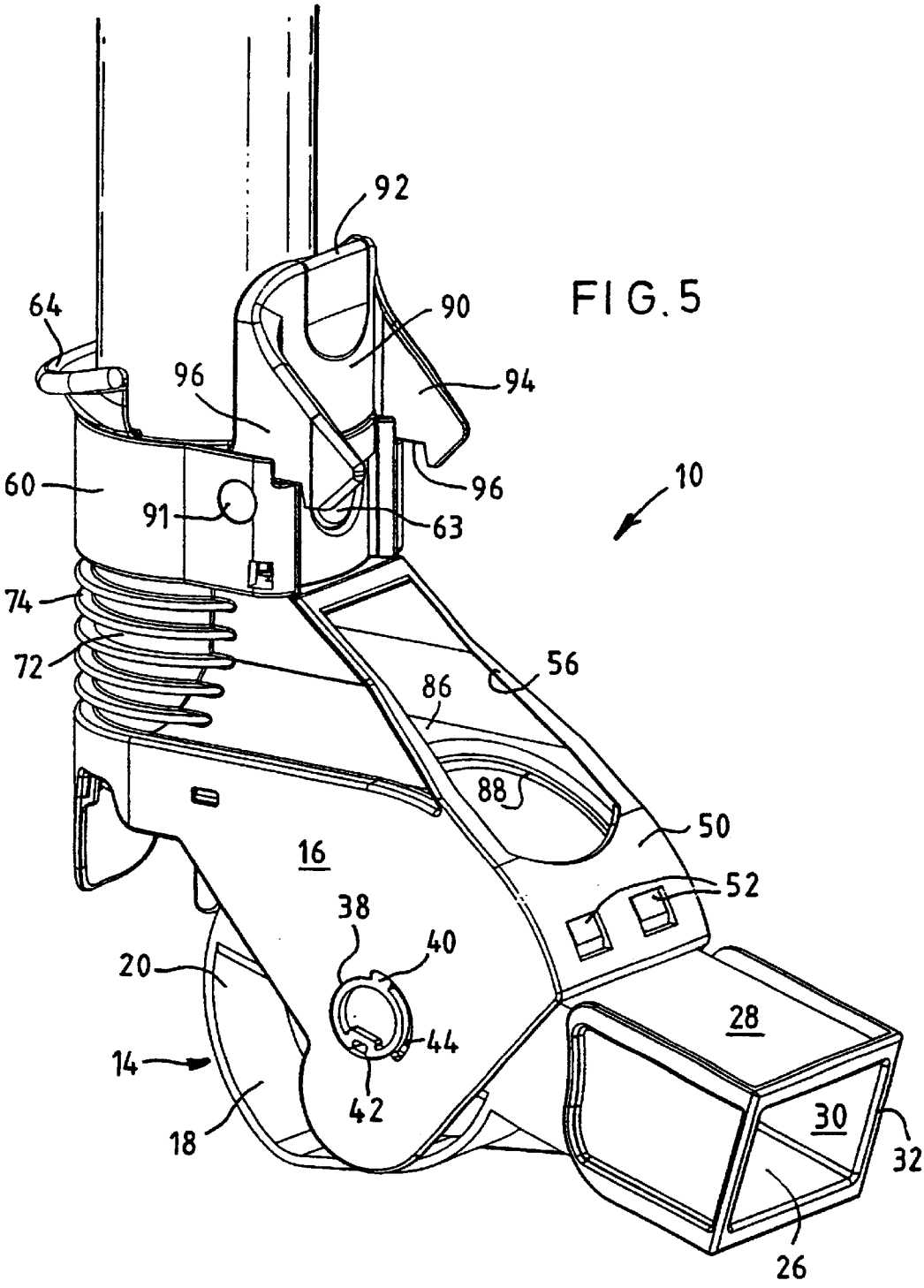
FIGS. 5 and 6 are perspective views of the removable portion shown in FIGS. 1 to 4 taken from the front and one side and from the rear and one side respectively and illustrating the connection of the apparatus to a vacuum cleaner hose for above-ground cleaning.
Figure 6:
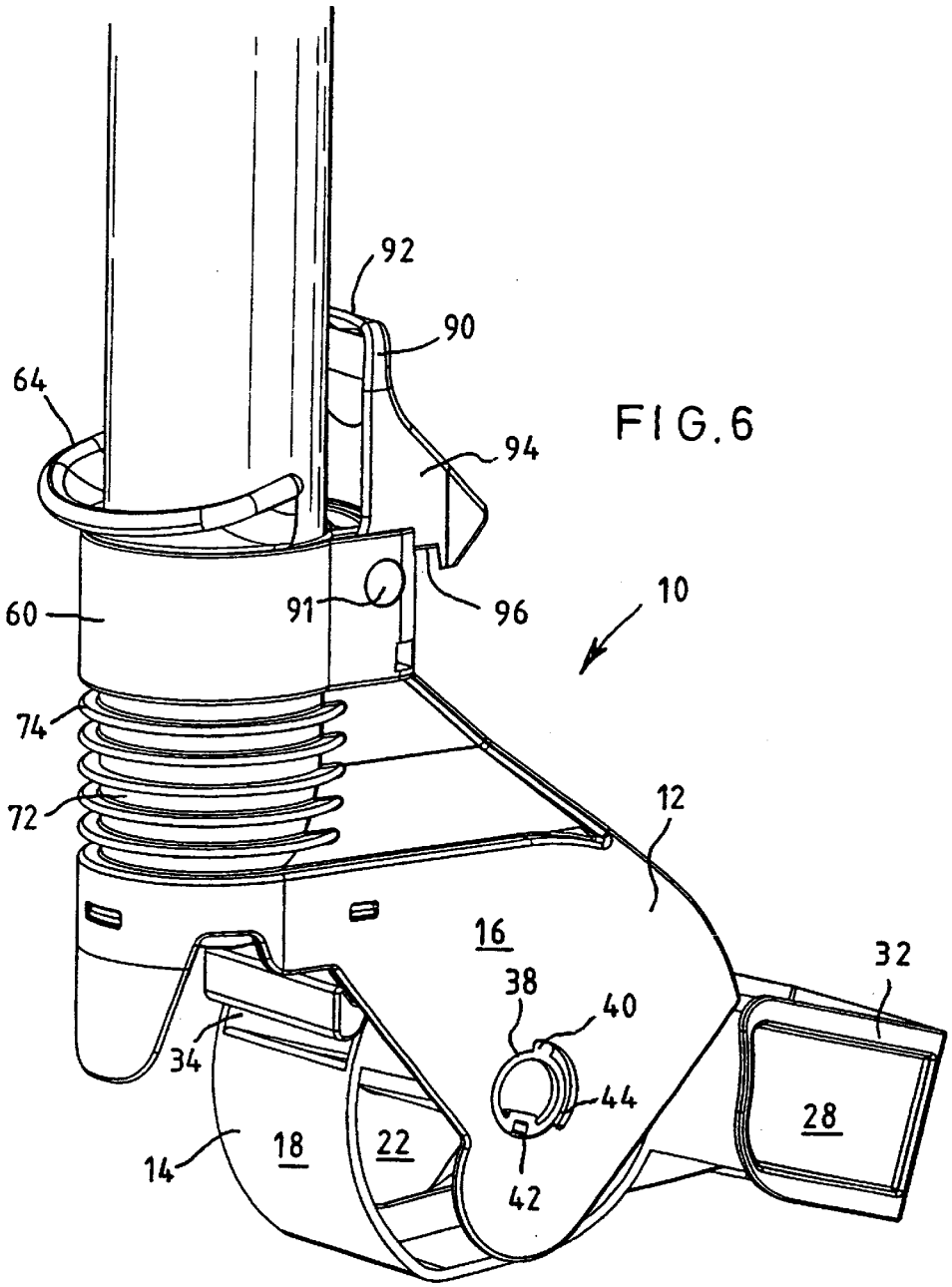

The removable portion illustrated in FIGS. 1 to 6 is designed to be particularly suitable for use in a vacuum cleaner. However, it is to be understood that this type of apparatus is equally applicable to other areas and can also be used for carrying a fluid other than air. Nevertheless, the specific embodiment described here, being an example only, relates to use in a vacuum cleaner.

As will be seen from FIGS. 1 to 6, the removable portion 10 generally consists of a housing 12 and a valve 14. The valve 14 is rotably mounted between two side walls 16 of the housing 12. The valve 14 consists of a generally cylindrical drum portion 18 moulded from a plastics material and having a generally cylindrical outer shell 20 supported by a central wall member 22. Apertures 24 are provided in the central wall member 22 in order to reduce the overall weight of the valve 14. The precise shape of the apertures 24 is not critical. The outer shell 20 is required to be cylindrical over more than half of its circumference in order to allow rotation of the valve 14 with respect to the housing 12 over a predetermined angle of rotation as will be described later. The remainder of the outer shell 20 need not be precisely cylindrical in shape and can be shaped to conform generally with the underside of the vacuum cleaner into which the removable portion is to be incorporated.

The drum portion 18 of the valve 14 incorporates an inlet conduit 26 running substantially diametrically therethrough. The upstream end of the inlet conduit 26 is extended beyond the outer shell of the drum portion 18 by conduit walls 28. A first air inlet 30 is defined by the upstream edges of the inlet conduit walls 28. The outer shell 20 incorporates an aperture 34 at the end of the inlet conduit 26 remote from the first air inlet 30 so as to allow air entering the inlet conduit 26 via the first air inlet 30 to exit the inlet conduit 26 via the aperture 34.

The valve 14 is rotatably mounted about an axis of rotation between the side walls 16 of the housing 12 so as to allow the valve 14 to rotate about the axis 36 with respect to the housing 12. The precise means of mounting the valve 14 between the side walls 16 is immaterial. However, in the embodiment shown, the drum portion 18 of the valve 14 incorporates opposing annular projections 38 centered on the axis of rotation 36. The annular projections 38 are adapted to co-operate with generally circular apertures 42 located in the side walls 16 of the housing 12, which apertures 42 are also centered on the axis of rotation 36. One of the annular projections 38 incorporates a radially projecting lug 40. The corresponding circular aperture 42 includes an enlarged portion 44 extending over approximately 135° of the circumference of the aperture 42 and adapted to co-operate with the radially projecting lug 40 to allow the radially projecting lug 40 to travel along the enlarged portion 44 between its ends. This arrangement limits the angle of relative rotation between the housing 12 and the valve 14 to the angle defined by the limit of travel of the radially projecting lug 40 within the enlarged portion 44 of the generally circular aperture 42, i.e. to approximately 105°.

The side walls 16 of the housing 12 are irregular in shape but extend generally upwardly from the lower portion incorporating the apertures 42 at an angle of roughly 45°. The side walls 16 are held in fixed spaced relation by an upper surface 50 which joins the upper inclined edges of the walls 16. The upper surface 50 includes two spaced apertures 52 for receiving and retaining in place resilient sealing means 54 forming a seal between the upper surface 50 and the outer shell 20 of the dnum portion 18 of the valve 14. The sealing means 54 remain in sealing contact between the outer shell 20 and the upper surface 50 at all times during operation of the removable portion 10. The upper surface 50 also defines an aperture 56 forming the air outlet from the removable portion 10.

The side walls 16 extend generally upwardly towards an upper collar 60. The upper collar 60 is generally U shaped in horizontal cross-section. Seated within the upper collar 60 is a lower hose cuff 61. The lower hose cuff 61 is held within the upper collar 60 by a resilient push button 63 which, when depressed, allows the lower hose cuff to be removed from the upper collar 60. The hose cuff 61 has a tubular wall 62 at the upper end of which is located a locating collar 64. The locating collar 64 extends upwardly of the upper collar 60 and over approximately 180° (see FIG. 3). The upper edge of the locating collar 64 is smoothly rounded so as to protect the hose of the vacuum cleaner from being damaged either by rubbing against the upper edge of the upper collar 60 or by becoming trapped between the upper collar 60 and the wand of the vacuum cleaner when in use.

The locating collar 64 is used to pull the hose cuff 61 out of the upper collar 60 when the push button 63 is depressed. A second tubular wall 66 is located radially inwardly of the tubular wall 62. The upper edge of the second tubular wall 66 is located below the upper edge of the tubular wall 62. The tubular walls 62,66 define a blind recess 68 in which an end of a hose of a vacuum cleaner can be located. The end of the hose, shown in FIGS. 5 and 6, will be fixed in the recess by adhesive.

The diameter of the second tubular wall 66 is selected so as to be able to slidably receive the wand of the vacuum cleaner. The second tubular wall 66 also projects into a conduit 70 via an aperture with which the second tubular wall 66 sealingly cooperates. The lower end of the second tubular wall is open and communicates with the conduit 70, which is delimited in part by the upper portions of the side walls 16 and a generally U shaped rearward portion 72 joining the upper portions of the side walls 16. Horizontally extending ribs 74 project from the generally U shaped rearward portion but have no functional purpose.

Directly below the second tubular wall 66 and below the conduit 70, a recess 76 is provided for receiving the lowermost end of the wand of the vacuum cleaner. Sealing means 78 are provided around the periphery of the recess 76 in order to provide a seal between the walls 80 of the recess and the wand when the wand is located in the recess 76. A closure member 82 is provided to close the base of the recess 76. The closure member 82 is made of a resilient material so as to provide a seal around the recess 76 when suction is applied in the conduit 70. A depending lip 83 forms a catch for retaining the mains lead of the vacuum cleaner in a wound position.

The conduit 70 extends substantially horizontally and forwardly from the area between the second tubular wall 66 and the recess 76. It is defined on either side by the upper portions of the side walls 16. The roof of the conduit 70 is defined by a wall 84 forming part of a moulding which locates and supports the second tubular wall 66. The wall 84 is located immediately below the forward edge of the upper collar 60. The floor of the conduit 70 is formed by a lower wall 86 which is formed integrally with the depending lip 83 but which is fixedly attached to the housing during manufacture. The lower wall 86 includes an aperture 88 so that the inlet conduit 26 can be brought into direct communication with the air outlet aperture 56 when the drum portion 18 is located so that the aperture 34 overlaps at least in part with the aperture 88.

Forwardly of the upper collar 60 and extending upwardly therefrom is a release member 90. The release member 90 is made from a plastics material and is pivoted about integrally moulded pins 91 to enable the upper end 92 of the release member 90 to be pressed rearwardly towards the locating collar 64. Compression springs (not shown) bias the release member 90 into the holding position in the Figures. Extending forwardly and downwardly from the release member 90 are opposing lugs 94 having upwardly extending recesses 96 located in the lower edge thereof. The recesses 96 are shaped and dimensioned so as to co-operate with projections located on a vacuum cleaner into which the removable portion 10 is to be incorporated. Rearward movement of the release member 90 against the biasing action of the compression springs releases the recesses 96 from the projections on the vacuum cleaner.

All of the component parts of the removable portion 10 illustrated in FIGS. 1 to 6 are intended to be manufactured from a plastics material, preferably by moulding. The seals may be made from natural or synthetic rubber. The separate parts are intended to be fitted together by snap-fitting or by adhesives. This allows the removable portion of the apparatus to be manufactured easily and economically and the assembly to be swift and therefore inexpensive.

Figure 7:
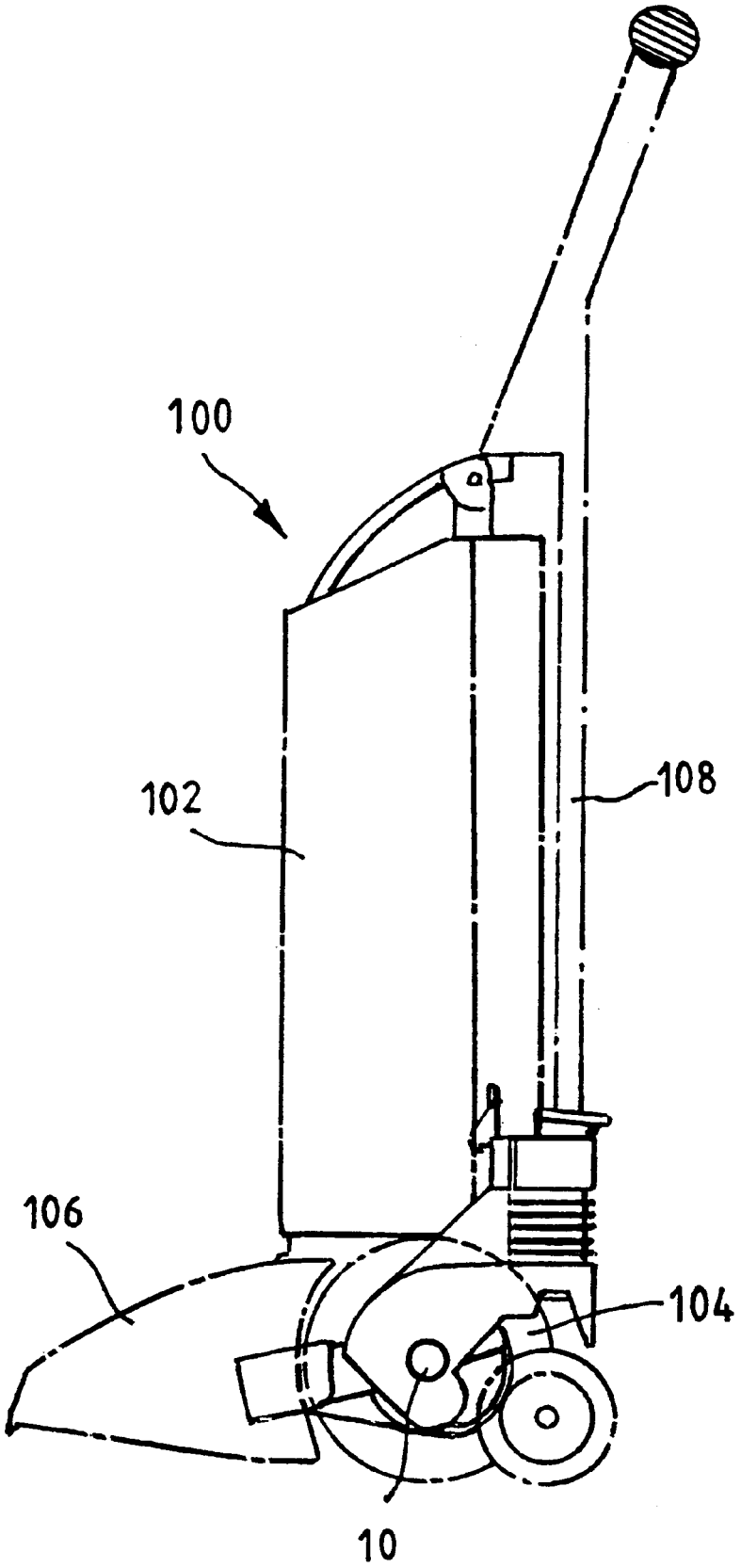
FIG. 7 is a schematic illustration showing the positioning of the removable portion of FIGS. 1 to 4 in a vacuum cleaner.

FIG. 7 illustrates schematically the overall construction of a vacuum cleaner intended to incorporate the removable portion 10 illustrated in FIGS. 1 to 6. In general, the vacuum cleaner 100 incorporates a main body 102 in which separating apparatus for separating dirt and dust from an airflow is located. A motor housing 104 is located at the lower end of the main body 102 and a cleaner head 106 is rotatably mounted on the motor housing 104. Extending upwardly from the motor housing 104 and alongside the main body 102 is a handle 108 which can be released from a socket so as to allow it to double as a hose/wand structure. A vacuum cleaner of this general type is shown and fully described in European patents Nos. 0134654B and 0037674B.

The removable portion 10 shown in FIGS. 1 to 6 is intended to improve this type of vacuum cleaner. The location of the removable portion 10 is indicated schematically in FIG. 7. The exact positioning and connection of the removable portion 10 to the remainder of the vacuum cleaner 100 will now be described with reference to FIGS. 8 and 9.

Figure 8:
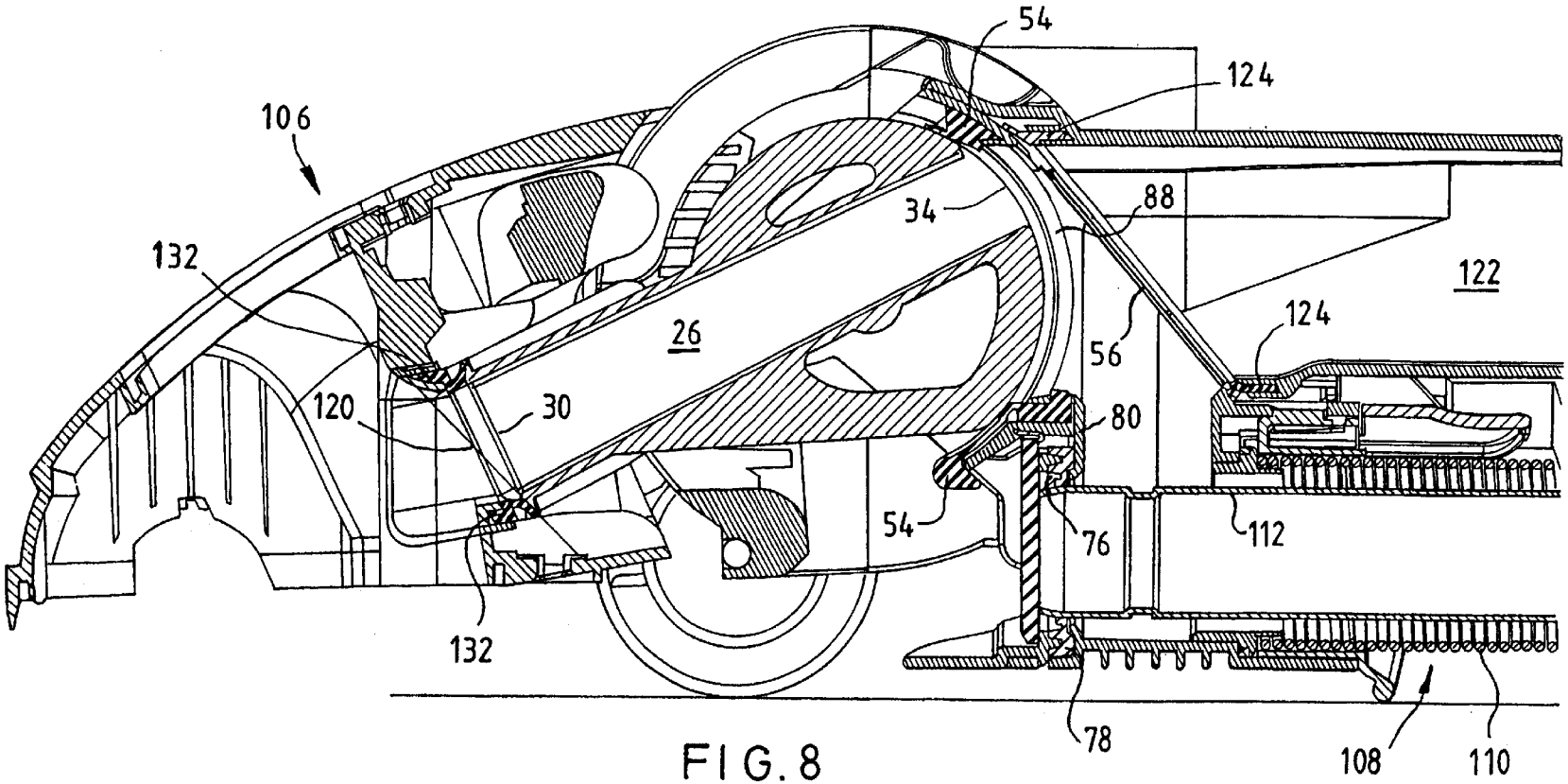
FIG. 8 is a longitudinal cross-section through part of the vacuum cleaner of FIG. 7 illustrating the position of the removable portion of FIGS. 1 to 4 when the cleaner is being used for on the floor cleaning.
Figure 9:
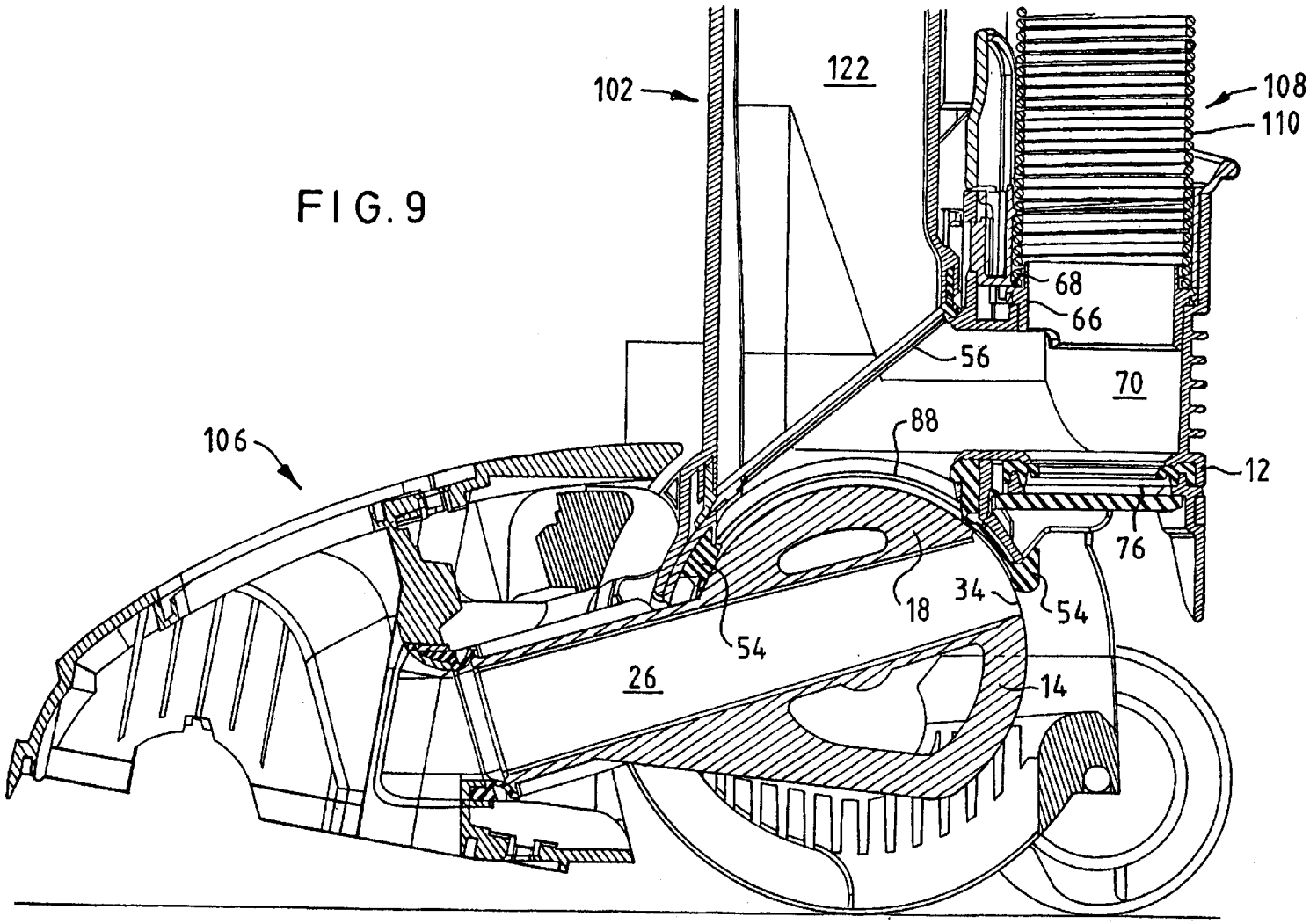
FIG. 9 is a view similar to FIG. 8 illustrating use of the cleaner in above-ground cleaning.

From FIGS. 8 and 9, it will be seen that the removable portion 10 is intended to form an integral part of the vacuum cleaner 100 illustrated in FIG. 7. The removable portion 10 is mounted within the motor housing 104 alongside the motor. This locates the drum portion 18 of the valve 14 below the dust separating apparatus and the recess 68 at the lower end of the hose/wand/handle assembly 108.

As in conventional in vacuum cleaners, the cleaner head 106 incorporates a brush bar (not shown) for beating and brushing a carpet and means for directing air sucked into the vacuum cleaner 100 via the cleaner head 106 to a single inlet opening 120 from which the dirty air can be conducted to the dust separating apparatus in the main body 102. The first air inlet 30 of the removable portion 10 is brought into sealing connection with the inlet opening 120 of the cleaner head 106. Resilient sealing means 132 form an airtight seal between the inlet opening 120 and the first air inlet 30. The resilient sealing means 132 are shown as being mounted on and carried by the cleaner head 106 around the inlet opening 120, but the sealing means 132 can also be carried by the removable portion 10 around the first air inlet 30.

The air outlet aperture 56 is brought into sealing connection with a conduit 122 leading to the dirt and dust separating apparatus in the main body 102 of the vacuum cleaner 100. Sealing means 124 are provided between the air outlet aperture 56 and the inlet to the conduit 122. The sealing means 124 are shown as being mounted on and carried by the conduit 122, but can also be carried by the removable portion 10 around the air outlet aperture 56.

The handle structure 108 of the vacuum cleaner 100 is connected to the removable portion 10 by way of the lower hose cuff 61, to which the hose 110 is attached, being seated within the upper collar 60. If the hose 110 needs to be released, the lower hose cuff 61 is simply removed from its seat within the upper collar 60. When the vacuum cleaner 100 is to be used in an upright mode, in which dirty air is sucked into the cleaner via the cleaner head, the lower end of the wand 112 is introduced into the recess 76 via the interior of the second tubular wall 66. In this position, the wand 112 forms the handle 108 by means of which the vacuum cleaner 100 can be manoeuvred across the surface to be cleaned.

The removable portion 10 is received snugly into a shaped recess in the motor housing 104 so that lateral and forward movement of the removable portion 10 with respect to the motor housing 104 is prevented. Projections located on the main body 102 or on the motor housing 104 of the vacuum cleaner 100 are arranged to co-operate with the recesses 96 in the lugs 94 so as to prevent unintentional rearward movement of the removable portion 10 with respect to the vacuum cleaner 100. The removable portion 10 is thereby held securely in position with respect to the remainder of the vacuum cleaner 100.

Operation of the vacuum cleaner in the upright mode will now be described with reference to FIG. 8. As can be seen, the lower end of the wand 112 is securely located in the recess 76 and the sealing means 78 provide an airtight seal between the wall 80 and the outer surface of the wand 112. The telescopic connection between the hose 110 and the wand 112 prevents any significant ingress of air into the conduit 70 past the wand 112 from the upper side of the removable portion 10. No dirty air can therefore pass into the conduit 70 via the wand 112 and the hose 110.

However, the aperture 34 at the end of the inlet conduit 26 leading from the first air inlet 30 and the cleaner head 106 is in communication with the conduit 122 leading to the dust separating apparatus in the main body 102 of the vacuum cleaner 100. This is because the aperture 34 overlaps with the aperture 88 when the handle 108 and main body 102 of the vacuum cleaner 100 are inclined to the vertical at an angle of inclination normally applied when the vacuum cleaner 100 is to be used in the upright mode. The inclination of the handle 108 and main body 102 causes the cleaner head 106 to rotate with respect to the motor housing 104 and this rotation causes the drum portion 18 of the valve 14 to rotate with respect to the housing 12 of the removable portion 10. The aperture 88 is sufficiently large to ensure that the aperture 34 overlaps at least partially with it at all angles of inclination of the main body 102 which are normally used during upright cleaning. The orientation shown in FIG. 8 illustrates the extreme position of the main body 102 lying substantially parallel to the surface to be cleaned; for example, when cleaning under furniture. It will be appreciated that the main body 102 can be raised to an inclination of 60–70° before the aperture 34 will cease to overlap with the aperture 88 and thus remove the connection between the first air inlet 30 and the air outlet aperture 56. Resilient sealing means 54 maintain an airtight seal between the housing 12 and the valve 14.

When the vacuum cleaner 100 is to be used in cylinder mode, perhaps for above ground cleaning, the handle 108 is moved to the essentially upright position. In this position, illustrated in FIG. 9, the drum portion 18 of the valve 14 is rotated with respect to the housing 12 so that the aperture 34 ceases to overlap with the aperture 88. The sealing means 54 prevent any air being drawn into the vacuum cleaner 100 via the ground engaging cleaning head 106. Instead, the wand 112 is released from the recess 76 and removed from the interior of the second tubular wall 66. The flexible hose 110, which is retained in the recess 68, and the wand 112 together defined the dirty air inlet to the vacuum cleaner 100. Dirty air entering the vacuum cleaner 100 via the wand 112 and hose 110 travels along conduit 70 and into the conduit 122 via the air outlet aperture 56. Therefore, in the cylinder mode, air is automatically drawn into the vacuum cleaner 100 via the hose/wand structure 108.

The nature of this arrangement means that there will be some portions of the airflow paths which will be prone to blocking. In the arrangement shown in FIG. 9, conduit 70 will be prone to blocking. In the arrangement shown in FIG. 8, blockages may occur at the interface between apertures 34 and 88. Occasionally, blockages may occur at the first air inlet 30. Furthermore, the seals between the removable portion 10 and the remainder of the vacuum cleaner 100 will be prone to wear and, naturally, the seals between the valve 14 and the housing 12 of the apparatus 10 will also be prone to wear.

The pronounced advantage of the invention over and above prior art arrangements is that the removable portion 10 can be easily and quickly removed from the remainder of the vacuum cleaner 100 so as to allow any blockages occurring within the removable portion 10 to be cleared. In order to remove the removable portion 10 from the remainder of the vacuum cleaner, the wand 112 is first removed from recess 76 and the hose 110 is then pressed away from the release member 90. Release member 90 is then pressed rearwardly until the projections previously held in the recesses 96 are released. The removable portion 10 is then simply slid rearwardly out of the recess in the motor housing 104. When the removable portion 10 has been removed from the vacuum cleaner 100, the hose can be removed by removal of the lower hose cuff 61. The inlet conduit 26 can then be easily accessed via the first air inlet 30 and the conduit 70 can be easily accessed via the air outlet aperture 56 in order to clear blockages. Any blockages occurring in the area of the upper collar can also easily be removed by hand. This means that the user of the vacuum cleaner can more easily remove blockages which have previously been awkward or impossible to access. The result is that the vacuum cleaner remains usable for a longer period of time and/or requires profession servicing less frequently.

In the event that the sealing means 54,78,132 etc. are located on the removable portion 10, replacement can be effected easily and quickly when the removable portion 10 is removed as described. If the sealing means are located on the remainder of the vacuum cleaner 100, access to the sealing means is greatly improved by removing the removable portion 10. A further advantage is that, should the removable portion 10 require extensive attention, a replacement removable portion can be swiftly inserted into the vacuum cleaner allowing the vacuum cleaner to be returned to operation with the minimum of delay.

It will be appreciated that the general principles of the removable portion 10 shown and described in relation to FIGS. 1 to 6 can be applied to apparatus for carrying a flow of fluid other than air. Appropriate modifications and alternative arrangements will be apparent to a reader skilled in the art.

What is claimed is:

1. A vacuum cleaner, comprising:

two fluid inlets, a fluid outlet, a plurality of alternative fluid flow paths between the inlets and the outlet, and a valve for opening one of the fluid flow paths to carry a fluid from one of the fluid inlets to the fluid outlet and closing at least one of the fluid flow paths, wherein one of the two fluid inlets is formed by a cleaner head of the vacuum cleaner and the other of the two fluid inlets is formed by a hose or wand, the valve being operated automatically to selectively connect the cleaner head to the fluid outlet during normal operation of the vacuum cleaner, and the valve being mounted within a housing such that the valve and the housing together form a removable portion of the vacuum cleaners, said vacuum cleaner further comprising a seal located between said removable portion and a remainder of said vacuum cleaner.

2. A vacuum cleaner according to claim 1, wherein the removable portion is retained in an operational position with respect to the remainder of the vacuum cleaner by quick-release clips.

3. A vacuum cleaner as claimed in claim 1, wherein each of the fluid flow paths incorporates a bend for changing the direction of flow of the fluid, the bend being housed within the removable portion of the vacuum cleaner.

4. A vacuum cleaner as claimed in claim 1, wherein the seal is carried by the removable portion.

5. A vacuum cleaner as claimed in claim 1, wherein the valve is rotatably mounted within the housing.

6. A vacuum cleaner as claimed in claim 1, wherein the valve opens more than one of the fluid flow paths to carry the fluid from one of the fluid inlets to the fluid outlet.

7. A vacuum cleaner according to claim 1, wherein the seal is exposed for access by removal of the removable portion.

8. A vacuum cleaner having two air inlets, at least one air outlet and a plurality of alternative airflow paths therebetween, a first of the two air inlets being, formed by a cleaner head of the vacuum cleaner and a second of the two air inlets being formed by a hose or wand, the vacuum cleaner further comprising a valve movable between a first position in which the first air inlet is open, and a second position in which the first air inlet is closed, the valve being moved between the first and the second positions automatically during normal operation of the vacuum cleaner, said valve and at least part of each of said alternative airflow paths being housed within a removable portion of the vacuum cleaner to facilitate maintenance, and seals are provided between the removable portion and the remainder of the vacuum cleaner.

9. A vacuum cleaner according to claim 8 wherein the seals are carried by the removable portion.

10. A vacuum cleaner according to claim 8 wherein the seals are exposed for access by the removal of the removable portion.

11. A vacuum cleaner having a plurality of operational positions, comprising:

a cleaner head fluid inlet, a second fluid inlet a fluid outlet, a plurality of alternative fluid flow paths between the inlets and the outlet, a removable portion comprising:

a housing, and a valve movable between a first position in which the cleaner head inlet is open and a second position in which the cleaner head inlet is closed, the valve being moved between said first and second positions automatically by a change in operational position of the vacuum cleaner, and a seal provided between said removable portion and a remainder of the vacuum cleaner.

12. A vacuum cleaner according to claim 11 wherein the seal is carried by the removable portion.

13. A vacuum cleaner according to claim 11, wherein the seal is exposed for access by the removal of the removable portion.

* * * * *